US008186020B2

(12) United States Patent
Schatzmann

(10) Patent No.: US 8,186,020 B2
(45) Date of Patent: May 29, 2012

(54) REVOLVING FLAT

(75) Inventor: Hans-Peter Schatzmann, Uesslingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 32 days.

(21) Appl. No.: 12/745,103

(22) PCT Filed: Nov. 28, 2007

(86) PCT No.: PCT/CH2007/000597

§ 371 (c)(1),
(2), (4) Date: May 27, 2010

(87) PCT Pub. No.: WO2009/067821

PCT Pub. Date: Jun. 4, 2009

(65) Prior Publication Data

US 2010/0306965 A1 Dec. 9, 2010

(51) Int. Cl.
*D01G 15/24* (2006.01)

(52) U.S. Cl. ..... 19/104; 19/113

(58) Field of Classification Search ..... 19/104, 19/113, 114

See application file for complete search history.

(56) References Cited

U.S. PATENT DOCUMENTS

| | | | | | |
|---|---|---|---|---|---|
| 564,691 | A * | 7/1896 | Hunton | 19/113 |
| 575,986 | A * | 1/1897 | Potter | 19/113 |
| 581,749 | A | 5/1897 | Mills | |
| 1,709,038 | A * | 4/1929 | Platt | 19/114 |
| 3,793,677 | A * | 2/1974 | Bechtel, Jr. | 19/113 |
| 3,936,911 | A * | 2/1976 | Roberts | 19/113 |
| 4,074,392 | A * | 2/1978 | Bechtel, Jr. | 19/113 |
| 4,221,023 | A * | 9/1980 | Henderson et al. | 19/113 |
| 4,528,724 | A * | 7/1985 | Bisquolm | 19/113 |
| 5,898,978 | A * | 5/1999 | Hollingsworth et al. | 19/114 |
| 6,101,680 | A * | 8/2000 | Naf et al. | 19/102 |
| 6,687,958 | B2 * | 2/2004 | Wurst | 19/98 |
| 7,559,122 | B2 | 7/2009 | Schatzmann et al. | |
| 2001/0018781 | A1 * | 9/2001 | Wurst | 19/113 |

FOREIGN PATENT DOCUMENTS

| | | | |
|---|---|---|---|
| DE | 128552 | | 5/1900 |
| GB | 11139 | | 0/1897 |
| GB | 11140 | | 0/1897 |
| GB | 22254 | | 0/1911 |
| SU | 537137 | | 11/1976 |
| SU | 1745782 | A2 | 7/1992 |
| WO | WO 2006/039829 | A1 * | 4/2006 |

OTHER PUBLICATIONS

International Search Report, Oct. 16, 2008.

* cited by examiner

*Primary Examiner* — Shaun R Hurley
(74) *Attorney, Agent, or Firm* — Dority & Manning, P.A.

(57) ABSTRACT

A method for fastening a clothing strip to a card-flat bar by a fastening means in the form of clips is presented. In this case, the clips are integrally formed onto the card-flat foot by press rams guided simultaneously from both sides of the card-flat bar and parallel to the plane of the clothing strip. The clip is integrally formed onto the card-flat foot and loops around the latter with a looping angle of less than 90° and more than 30°. A corresponding tool for carrying out the method and also a revolving card flat are likewise proposed.

12 Claims, 3 Drawing Sheets

REVOLVING FLAT

FIELD OF THE INVENTION

The invention relates to a revolving card flat with a card-flat bar which has a card-flat foot and a web lying above the card-flat foot, and with a flexible clothing in the form of a clothing strip and with at least one fastening element in the form of a clip, the clip being attached with a first portion to the clothing strip, being led with a second portion along one longitudinal side of the card-flat bar and partially looping with a third portion around the card-flat foot with a looping angle. The looping angle is defined as the angle between the perpendicular, touching the side face of the card-flat foot, to the clothing bearing face of the card-flat foot and that face of the card-flat foot onto which the third portion of the clip is integrally formed.

BACKGROUND OF THE INVENTION

Various types of construction of revolving card flats are known from the prior art. Revolving card flats are used in carding. The revolving card flats employed currently consist essentially of a card-flat bar with a clothing. The card-flat bar is composed of a card-flat foot and web lying above the latter. The clothing is fastened to the card-flat foot with the aid of clips. The clothing itself is used in the form of clothing strips, on the underside of which a multiplicity of clothing needles in the form of small wire hooks are fastened. At the two ends of a card-flat bar, devices are provided which makes it possible to fasten the card-flat bar to a chain or a belt.

U.S. Pat. No. 581,749 discloses a revolving card flat and a corresponding tool for fastening the clothing strip to the card-flat foot. In this case, first, the clips are connected to the clothing strip. In a further step, the clothing strip is joined together with the card-flat bar, and subsequently the free portions of the clips are bent around the card-flat foot, so that the clothing strip comes to lie, free of play, on the card-flat foot. The card-flat foot is in this case surrounded by the clips in a bracket-like manner. To make the connection between the card-flat foot and clothing strip by means of clips, a complicated movement of the two used is necessary.

DE 128 552, likewise, discloses the fastening of a flexible clothing in the form of a clothing strip to the card-flat foot of a card-flat bar. The clip used in this case, on the one hand, engages into the foundation of the clothing strip and, on the other hand, engages around or surrounds the card-flat foot. This makes it possible for the lining material of the foundation of the clothing strip to lie firmly on the card-flat foot. Here, too, the disadvantage is that clips bent on both sides have to be manufactured.

FIG. 1 shows a device, such as is used for drawing clothing strips onto card-flat bars. The card-flat bar 1 is built onto a clothing strip 10 previously laid into a holding device 8, so that the card-flat foot 3 comes to lie on the clothing strip. The clips 5 are already fastened to the clothing strip 10 on longitudinal sides of the latter. The card-flat bar 1 is consequently introduced with the card-flat foot 3 between the clips 5. With the aid of prebending rollers 6, the clips 5 are performed. In a second step, by means of the form rollers 7, the clips 5 are integrally formed onto the card-flat foot 3. The prebending rollers 6 and form rollers 7 are moved in the longitudinal direction of the card-flat bar 1 for the integral formation of the clips 5, while the rollers rotate and are pressed against the card-flat foot 3. The device shown has the disadvantage that only a specific shape of the card-flat foot 3 fits together with the predetermined form rollers 7. Also, complicated movement and clamping mechanisms are necessary so that the operation described above can be carried out.

WO 2006/039829 discloses a further example of a device for attaching a clothing strip to a card-flat bar. A prepared clothing strip, in which the clips are already fastened with a first portion on both sides, is introduced into the device. The card-flat bar is subsequently introduced into the device with the card-flat foot against the clothing strip so that the clips lead with a second portion along the longitudinal sides of the card-flat foot. The bending cheeks of the device are then pivoted inwards against the card-flat bar, with the result that the third portion of the clips is integrally formed onto the card-flat foot. To generate the necessary holding force, in addition, a deformation of the clips along the longitudinal sides of the card-flat foot is generated by means of press battens. One disadvantage of the device is that a plurality of movements of pressing tools and bending cheeks are necessary in order to achieve a fastening of the clothing to the card-flat bar. Also, there is the risk that, in the case of excessive deformation of the clip, a change in shape of the overall card-flat bar may occur, because various elements of the card-flat foot are spanned by the clips.

The prior art for fastening clothing strips to card-flat bars with the aid of clips likewise entails the disadvantage that the card-flat foot has to be subjected over its entire length and width and also its height to a narrow manufacturing and dimensional tolerances. In order to achieve a reliable fastening of the clothing strips, an exact coordination of the pressing tool, form rollers, dimensions, and shape of the card-flat foot with the dimensions of the clips and their material properties is necessary. This leads to a cost-intensive production of the individual parts and also of the equipment necessary for assembling them.

An object of the present invention, then, is to avoid the disadvantages of the prior art and to provide a simple connection between the card-flat foot and clothing, without having to allow for any loss of holding force.

SUMMARY OF THE INVENTION

Objects and advantages of the invention are set forth in part in the following description, or may be obvious from the description, or may be learned through practice of the invention.

Objects are achieved by means of the type of construction of a revolving card flat of the type mentioned in the Field of the Invention and by means of the method and the tool necessary for this, in accordance with aspects of the invention as set forth herein. Certain objects are achieved in that the clip loops with a third portion around the card-flat foot with an angle of between 90° and 30° (degrees of angle).

A revolving card flat according to the invention has a card-flat bar. The card-flat bar is composed of the card-flat foot and of a web lying above the card-flat foot. Card-flat bars are currently produced mostly from one piece from steel, cast iron, or in the form of hollow profiles consisting of light metal or light metal alloys. Card-flat bars consisting of plastic or of composite materials may also be envisioned. A clothing is attached to that side of the card-flat foot which lies opposite the web, the clothing bearing face of the card-flat bar. In this case, mostly, flexible clothings are used. A flexible clothing comprises a foundation which is constructed from a plurality of fabric layers and which is pierced by needles. The clothing is produced in the form of strips, the width and length of these clothing strips corresponding to the dimensions of the card-flat foot. The clothing strips and the card-flat foot are held together along the longitudinal sides of the card-flat foot with the aid of fastening elements, which are known as clips. The clips have a first portion which is connected to the clothing strip. This takes place mostly by pricking into the foundation and by subsequently bending round the clips, so that a second portion of the clips leads along the lateral longitudinal edges of the clothing strip, parallel to the side faces of the latter or the longitudinal edges of the card-flat foot, in the direction of the web. A third portion of the clips then projects away from the clothing strip beyond the card-flat foot.

There has previously been the belief that a sufficiently high holding force for operational requirements between the card-flat foot and the clothing strip can be achieved only by a crimping of the clip. This meant bending the third portion of the clip around through more than 90°, thus resulting in a looping around of the card-flat foot of more than 90°. Thus, bending resulted in a bracketing of the card-flat foot, which was intended to prevent the clip from slipping off laterally. According to the invention, however, by the clip being integrally formed onto the contour of the card-flat foot, a holding force sufficient for the requirements can be achieved even in a case of a looping around of less than 90°. Fastening the clothing strip simultaneously from both sides gives rise in the clothing strip to a tension which assists the frictional connection achieved by the clip fitting snugly against the card-flat foot. The frictional connection is achieved by the card-flat foot being looped around by the third portion of the clip. In this case, it was shown that a looping around of less than 90° leads, between the card-flat foot and the clip, to a frictional connection which fulfills the requirements to be met during operation by the connection of the card-flat foot and clothing strip. As regards the production and releasability of the connection, a looping angle of less than 70°, in particular of 60°, proved to be advantageous. In order to obtain a sufficiently high holding force via the frictional connection, a looping angle of more than 30°, preferably of more than 50°, is advantageous.

In a preferred version of the invention, the clip is manufactured from light metal or a light metal alloy. The necessary forces for integrally forming the clip onto the card-flat bar are thereby reduced. In particular, the use of clips consisting of aluminium or of an aluminium alloy has proved appropriate. The card-flat bars, too, may be produced from light metal or light metal alloy. In particular, the card-flat bars may be designed as hollow profiles. The use of aluminium or of an aluminium alloy is also advantageous.

The method for integrally forming the clips onto the card-flat foot is characterized by the use of simple press rams. The press rams in this case act simultaneously from both sides of the card-flat bar on the clips to be integrally formed. The press rams are in this case to be moved towards one another transversely to the longitudinal direction of the card-flat bar. The movement of the press rams takes place linearly in a plane which is parallel to the plane of the clothing strip. The press rams may be provided with a drive. The drive may take place electrically, pneumatically or hydraulically. A purely mechanical drive which can be actuated by hand may also be envisioned.

In a preferred version, the card-flat bar has an additional rib above the card-flat foot which leads along, parallel to the card-flat foot, over the length of the card-flat bar. The rib in this case forms, together with the card-flat foot, a guide for the press rams. The press rams are guided by this rib in their movement in such a way that they cannot avoid the clip.

The press rams are preferably manufactured from an elastic material, preferably from a thermoplastic, in particular polyethylene or polyamide. As a result, that part of the press ram which slides along on the card-flat foot and the third portion of the clip is deformed. Owing to this deformation, the press ram adapts to the contour of the clip and of the card-flat foot, thus leading to the clip being integrally formed onto the card-flat foot. By the clip being integrally formed exactly onto the contour of the card-flat foot in this way, unevenesses in the card-flat foot can be compensated. A compensation of production or dimensional tolerances on the card-flat bar is also possible. Already used and therefore slightly damaged card-flat bars may be reequipped with a clothing strip by means of the proposed method. When pressing operation has ended, the rams are retracted and resume their original shape.

The tool used for carrying out the method makes it possible to receive a card-flat bar. The clothing strip, together with the clips already fastened to it, and the card-flat bar are introduced into the tool. The clothing strip and the card-flat bar are subsequently retained in their position with respect to one another. For this purpose, means are provided which, on the one hand, make it possible to position the clothing strip and card-flat bar, for example guides, and, on the other hand, fix this position, for example cramp it or clamp it. Advantageously, the card-flat bar is attained during the following pressing operation by means of a holding-down device. The press rams moving forward simultaneously from both sides may be manufactured from one piece and extend over the entire length of the clothing strip to be fastened. A division of the press ram into individual segments may also be envisioned, in which case the drive for the press ram may likewise be apportioned to individual segments.

BRIEF DESCRIPTION OF THE DRAWINGS

The invention is explained in more detail below with reference to exemplary embodiments and by means of drawings in which.

DETAILED DESCRIPTION OF THE INVENTION

Figure 1:
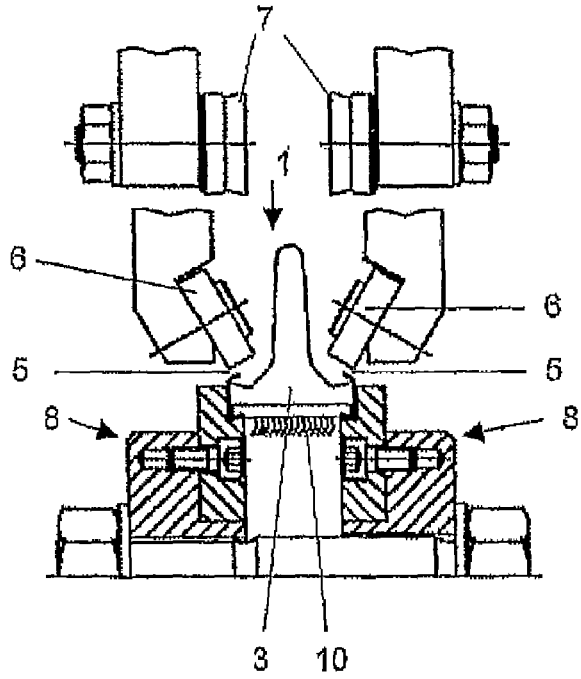
Fig. 1 PRIOR ART
FIG. 1 shows a diagrammatic illustration of a device for assembly of a card-flat bar and clothing according to the prior art.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows an arrangement, conventional according to the present-day prior art, of a device for assembly of a card-flat bar and clothing strip to form a revolving card flat. The figure was discussed in detail under the prior art, and therefore a further description is dispensed with at this juncture.

Figure 2:
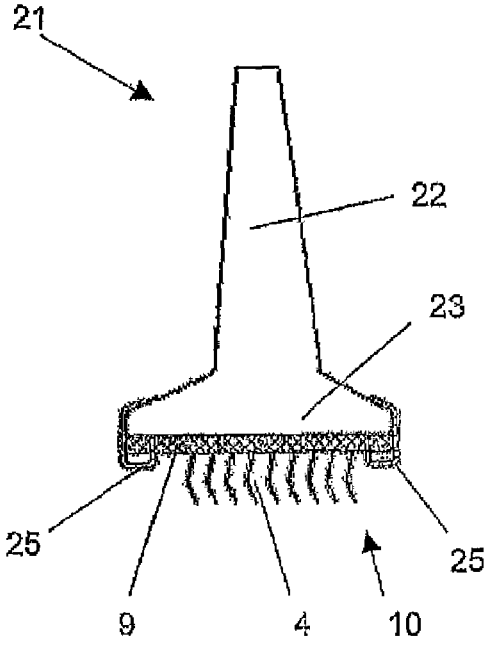
FIG. 2 shows a diagrammatic illustration of a cross section of a first revolving card flat according to the invention.

FIG. 2 shows a cross section of a revolving card flat according to an embodiment of the invention. The clothing strip 10 consists of the foundation 9 and of the needles 4 which are held in the latter and which constitute the actual clothing. The clothing strip is held on the card-flat foot 23 on each of the two sides by means of a clip 25. The card-flat foot 23 and the web 22 located above it form the card-flat bar 21. This card-flat bar 21 is provided (not illustrated) at its outer ends with a card-flat end head in each case.

Figure 3:
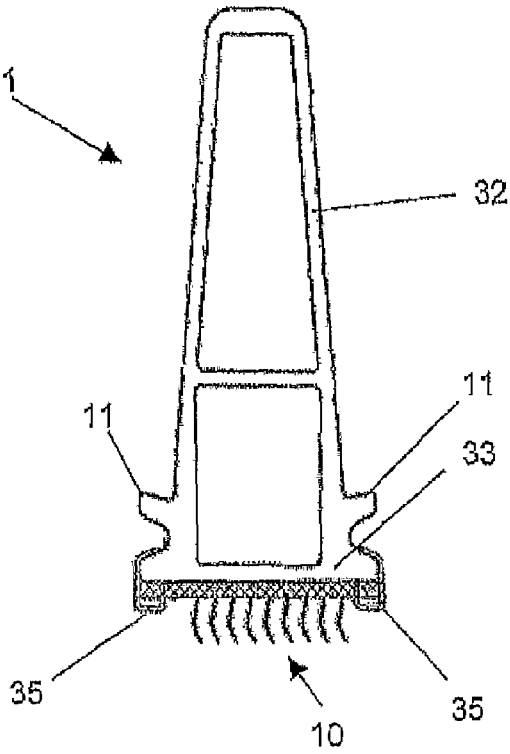
FIG. 3 shows a diagrammatic illustration of a cross section of a second revolving card flat according to the invention.

FIG. 3 shows a cross section of a further revolving card flat according to another embodiment of the invention. The card-flat bar 31 is designed as a hollow profile, the hollow profile increasing in width towards the clothing strip 10 and forming the web 32. A card-flat foot 33 is formed at the lower end of the hollow profile. The slender part of the hollow profile in this case forms the web 32. A rib 11 is integrally formed on the web 32 on both sides above the card-flat foot 33 and runs over the entire length of the card-flat bar 31. A clothing strip 10 is attached on that side of the card-flat foot 33 which lies opposite web 32, the clothing bearing face. The clothing strip 10 is held on the card-flat foot 33 by means of clips 35 attached to the longitudinal sides of the card-flat bar 31.

Figure 4:
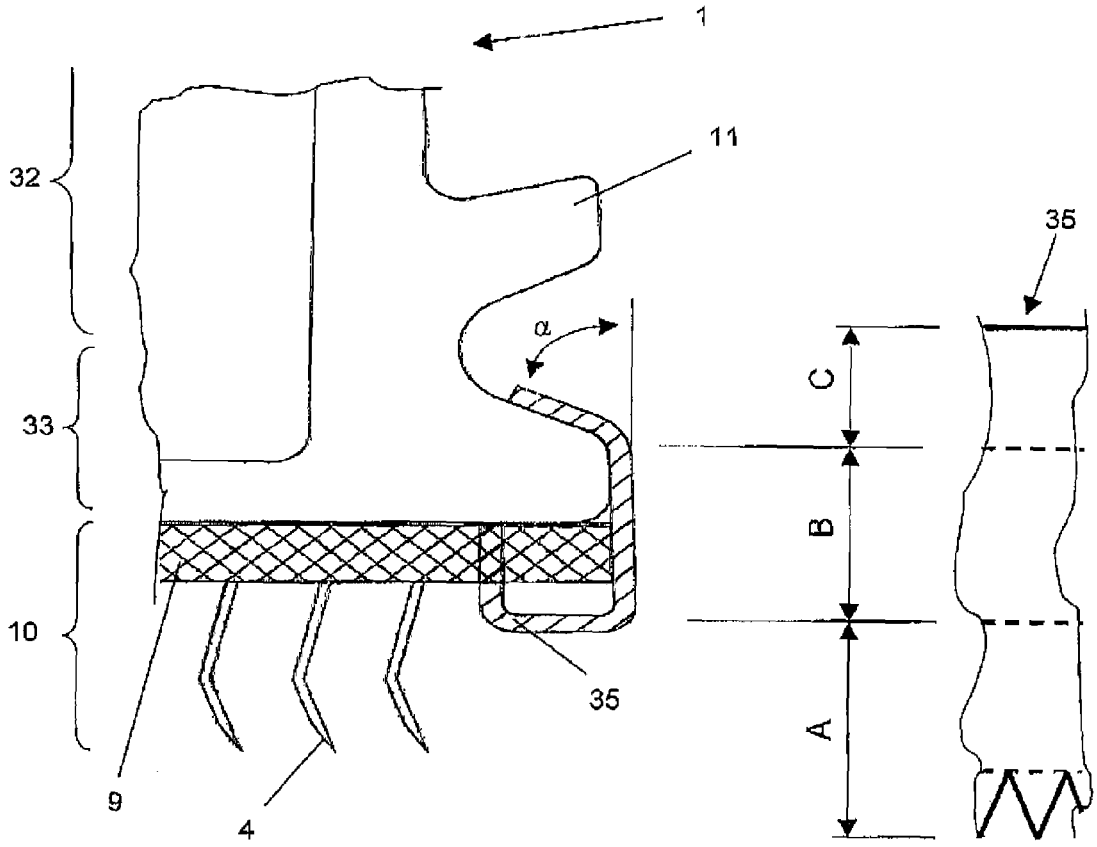
FIG. 4 shows a view of a detail of the fastening of a clothing strip to the card-flat foot.

FIG. 4 shows a view of a detail from FIG. 3. The clothing strip 10 consisting of the foundation 9 and of the clothing 4 is fastened to the card-flat foot 33 by means of the clip 35. The web 32 is laid, opposite the clothing strip 10, against the card-flat foot 33. The card-flat bar 31 is produced in one piece, so that the card-flat foot 33 and the web 32 merge one into the other without any visible parting line. The clip 35 is illustrated, laid out, in a side view in the further part of FIG. 4. In this case, the region A constitutes a first portion of the clip 35. This is provided at the outer margin with serrations which, in the fastened state, engage into the foundation 9 of the clothing strip 10. The region B designates a second portion of the clip 35 which, in the installed state, is led along the longitudinal side of the clothing strip or of the card-flat foot. The region C constitutes a third portion of the clip 35. This is integrally formed onto the card-flat foot 33 and loops around the latter at the angle $\alpha$. The looping angle $\alpha$ is defined as the angle between the perpendicular, touching the side face of the card-flat foot 33, to the clothing bearing face of the card-flat foot 33 and that face of the card-flat foot 33 onto which the third portion (region C) of the clip 35 is integrally formed. The third portion (region C) of the clip 35 is bent away at the looping angle $\alpha$ out of alignment with the second portion (region B) of the clip 35, so that this third portion (region C) bears against the card-flat foot 33.

Figure 5:
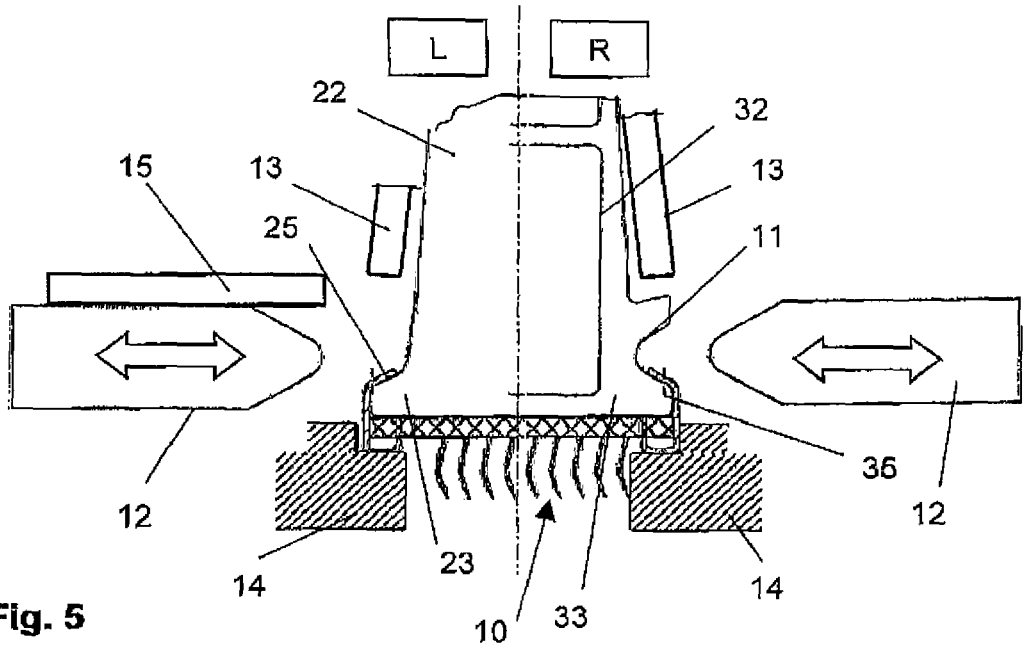
FIG. 5 shows a diagrammatic illustration of the tool for producing a revolving card flat according to the invention.

FIG. 5 shows diagrammatically the tool for fastening the clothing strip 10 to the card-flat bar 21, 31. The half, designated by L, of FIG. 5 illustrates a card-flat bar 21 according to FIG. 2. The half, designated by R, of FIG. 5 illustrates a card-flat bar 31 according to FIG. 3. Irrespective of the differences between the two card-flat bars 21, 31, the procedure is the same for fastening the clothing strips 10 to the card-flat bars 21, 31 or card-flat feet 23, 33. The clothing strip 10 is introduced into a receptacle 14 in the tool. In this case, a depression is arranged centrally in the receipt 14 over the length of the card-flat bar 21, 31, so that the clothing strip 10 is not damaged during the fastening operation. The clips 25, 35 have in this case already been attached to the clothing strips 10 beforehand. The regions B and C (FIG. 4) of the clips 25, 35 are located in a plane which runs (not illustrated) advantageously perpendicularly to the clothing strip foundation. The card-flat bar 21, 31 is introduced from above between the regions B and C of the clips 25, 35 (see FIG. 4). By means of holding-down device 13, the card-flat bar 21, 31, together with the clothing strip 10 lying beneath it, is pressed against the receptacle 14 and thus fixed. The card-flat bar 21, 31 and clothing strip 10 are thus tension-mounted between the receptacle 14 and the holding-down device 13 engaging on the web 23, 33.

In a next step, the two press rams 12 are led simultaneously up to the card-flat bar 21, 31 from both sides of the latter. The press ram 12 presses the third portion (region C) of the clip 25, 35 against the card-flat foot 23, 33 upon further movement. As a result, the third portion of the clip 25, 35 is integrally formed against the card-flat foot 23, 33 by the press ram 12. The press ram 12 is preferably manufactured from an elastic material, so that is slides over the third portion of the clip 25, 35, while the press ram 12 adapts to the contour of the card-flat foot 23, 33. As a result of this type of "bending" of the third portion of the clip 25, 35, the second portion of the clip 25, 35 is drawn upwards against the ram 12. Since this effect occurs on both sides of the card-flat foot 23, 33, the clothing strip 10 is drawn apart and tensioned.

In the half, designated by R, of FIG. 5, in a preferred version of the invention, the rib 11 is formed above the card-flat foot 33. The rib 11 is shaped in such a way that its inclination gives rise to a preferably symmetrical depression between the rib 11 and the card-flat foot 33, together with the inclination of the surface of the card-flat foot 33. The middle of the press ram 12 preferably runs congruently with the middle of this depression. The connecting line between the middle of the depression and the middle of the press ram 12 corresponds at the same time to the direction of linear movement of the press ram 12.

In the half, designated by L, of FIG. 5, there is no rib 11 present in the version of the card-flat bar 21, as shown. As a replacement for the absent rib 11, but with the same function, to be precise that of avoiding an evasion of the press ram 12, a ram guide 15 is attached to the ram 12 itself. The ram guide 15 is advanced together with the press ram 12. As a result, the insertion of the clothing strip 10 and of the card-flat bar 21 is not impeded when the press rams 12 are in their initial position, as illustrated in FIG. 5. Owing to this measure, the application of the method does not depend on a type of construction of the card-flat bar which is specifically coordinated with it.

The press rams 12 may be moved by means of mutually independent linear drives. The drive may be of the electrical, pneumatic or hydraulic type of construction. A connection of the press rams 12 may also be envisioned, for example by means of a linkage, in order to move both press rams 12 by means of the same drive. A mechanical drive actuated by hand may likewise be provided. If the holding-down device 13, too, is provided with a drive, an automatic flow of the overall method may be envisioned.

Figure 6:
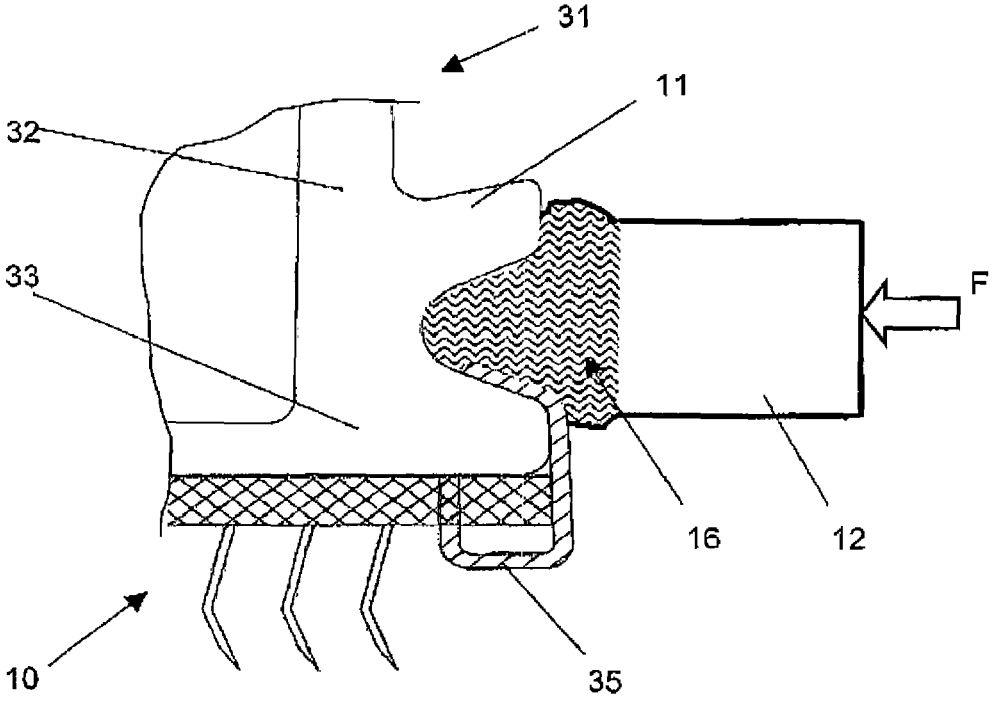
FIG. 6 shows a diagrammatic illustrations of a cross section of a revolving card flat according to the invention during a pressing operation.

FIG. 6 shows a detail of the cross section of a revolving card flat according to the invention from the right half, designated by R, of FIG. 5 during the pressing operation, the press ram 12 being shown in the foremost position. The press ram 12 is pressed against the card-flat foot 33 with the force F. On account of its elasticity, the front part 16 of the press ram 12 which has penetrated into the depression between the card-flat foot 33 and the rib 11 is deformed. The deformed part 16 of the press ram 12 fills the entire depression, adapts to the contour and is partially upset. With the press ram 12 being adapted with is front part 16 to the contour of the depression by pressing with the force F, the card-flat bars 31 can be manufactured with greater tolerance in terms of the shape of that side of the card-flat foot 33 which lies opposite the clothing strip 10 and of the rib 11. Also, after being used more than once, the card-flat bars 31 can be reused without any remachining of the faces and shapes against which the clip 35 bears.

The force F to be applied is to be coordinated with the selected elasticity of the press ram 12, with the contour of the card-flat bar 31 to be filled and with the clip 35 selected for fastening the clothing strip 10.

Modifications and variations can be made to the embodiments illustrated or described herein without departing from the scope and spirit of the invention as set forth in the appended claims.

The invention claimed is:

1. A revolving card flat comprising:

a card-flat bar having a card-flat foot, a web lying above the card-flat foot, a flexible clothing in the form of a clothing strip, and at least one fastening element in the form of a clip;

the clip attached by a first portion to the clothing strip;

the clip having a second portion that extends along one longitudinal side of the card-flat bar;

the clip having a third portion that partially loops around the card-flat foot with a looping angle that is less than 90° and greater than 30°.

2. The revolving card flat according to claim 1, wherein the looping angle is less than 70° and greater than 50°.

3. The revolving card flat according to claim 2, wherein the looping angle is 60°.

4. The revolving card flat according to claim 1, wherein the clip is manufactured from metal or a metal alloy.

5. The revolving card flat according to claim 1, wherein the card-flat web has a rib disposed above the card flat foot along the longitudinal direction of the card-flat web, the third portion of the clip formed against the card flat foot below the rib.

6. A method for fastening a flexible clothing in the form of a clothing strip to a card-flat bar of a revolving card flat with two clips, the card-flat bar having a card-fiat foot and a web lying above the card-flat foot, the method comprising:

fastening a first portion of the clips to mutually opposite longitudinal sides of the clothing strip;

forming a second portion of the clips to extend along the longitudinal sides of the card-flat bar;

forming a third portion of the clips against the card-flat foot with oppositely oriented press rams that move simultaneously and transversally relative to the longitudinal direction of the card-flat bar, the press rams guided simultaneously from both sides so as to move parallel to the plane of the clothing strip.

7. The method according to claim 6, wherein the press rams are driven by any one or combination of electrical, hydraulic, or mechanical means.

8. The method according to claim 6, wherein the press rams are guided by ribs that are part of the card-flat bar or by ram guides that are separate from the card-flat bar.

9. The method according to claim 6, wherein the press rams are deformable to the shape of the card-flat foot upon being pressed against the card-flat foot and, after the pressing operation, resume their original shape.

10. A tool for fastening a flexible clothing in the form of a clothing strip to a card-flat bar of a revolving card flat with two clips, the card-flat bar having a card-flat foot and a web lying above the card-flat foot, the clips having a first portion fastened to mutually opposite longitudinal sides of the clothing strip and a second portion that extends along the longitudinal sides of the card-flat bar, the tool comprising:

a receptacle for receipt of the card-flat bar with a third portion of the clips extending above and generally parallel to the longitudinal sides of the card-flat bar; and opposite press rams configured for simultaneous transverse movement relative to the longitudinal orientation of the card-flat bar within the receptacle so as to engage and press the third portion of the respective clips inwards against a bearing face of the card-flat foot.

11. The tool according to claim 10, wherein the press rams have the same length as the clothing strip to be fastened.

12. The tool according to claim 10, wherein the press rams are manufactured from a deformable, elastic material.

* * * * *